US006739651B1

(12) United States Patent
Barefoot

(10) Patent No.: US 6,739,651 B1
(45) Date of Patent: May 25, 2004

(54) CONVERTIBLE SEATING FURNITURE

(75) Inventor: James E. Barefoot, Winston Salem, NC (US)

(73) Assignee: Krueger International Inc., Green Bay, WI (US)

( * ) Notice: Subject to any disclaimer, the term of this patent is extended or adjusted under 35 U.S.C. 154(b) by 0 days.

(21) Appl. No.: 10/374,896

(22) Filed: Feb. 25, 2003

(51) Int. Cl.[7] ..... A47C 17/04; A47C 17/13; A47C 17/207; A47C 17/213; A47C 13/00

(52) U.S. Cl. ..... 297/118; 297/105; 297/108

(58) Field of Search ..... 297/118, 105, 297/108, 109, 110, 111

(56) References Cited

U.S. PATENT DOCUMENTS 1,362,444 A * 12/1920 Spector et al. ..... 297/108 X
1,770,759 A * 7/1930 Mckellar ..... 297/108
2,155,490 A * 4/1939 Hoehl ..... 297/108
2,260,079 A * 10/1941 Lombardi et al. ..... 297/108 X
2,937,384 A * 5/1960 Fossum ..... 297/105 X
3,145,049 A * 8/1964 Duke ..... 297/105
3,504,940 A * 4/1970 Friese ..... 297/105
3,596,984 A * 8/1971 Jones et al. ..... 297/105
3,600,034 A * 8/1971 Jones et al. ..... 297/105
3,867,730 A * 2/1975 Wright ..... 297/118 X
4,226,470 A * 10/1980 Wittman et al. ..... 297/108
4,292,697 A * 10/1981 Alembik ..... 297/105 X
4,538,308 A * 9/1985 Grigoriev ..... 297/105 X
4,563,037 A * 1/1986 Tiffany ..... 297/105
5,779,310 A 7/1998 Suskey et al. ..... 297/118 X
6,588,837 B1 * 7/2003 Schultz et al. ..... 297/118 X

* cited by examiner

*Primary Examiner*—Peter M. Cuomo
*Assistant Examiner*—Rodney B. White
(74) *Attorney, Agent, or Firm*—Boyle, Frederickson, Newholm, Stein & Gratz, S.C.

(57) ABSTRACT

An article of seating furniture including an extendable support assembly that is movable to convert the assembly from an upright position to a supine position. The extendable support assembly includes a pedestal having a pair of guide tracks with upwardly extending notches disposed on opposite sides of the pedestal. The notches in each guide track are engageable with rollers disposed on a frame of the article of seating furniture, in order to guide the pedestal during movement toward and away from the chair. A backrest assembly is pivotally connected between the frame and the pedestal and moves in conjunction with the pedestal between the upright position and the supine position. The assembly is maintained in the upright position by engagement of the rollers on the frame within the notches in the tracks on the pedestal.

23 Claims, 8 Drawing Sheets

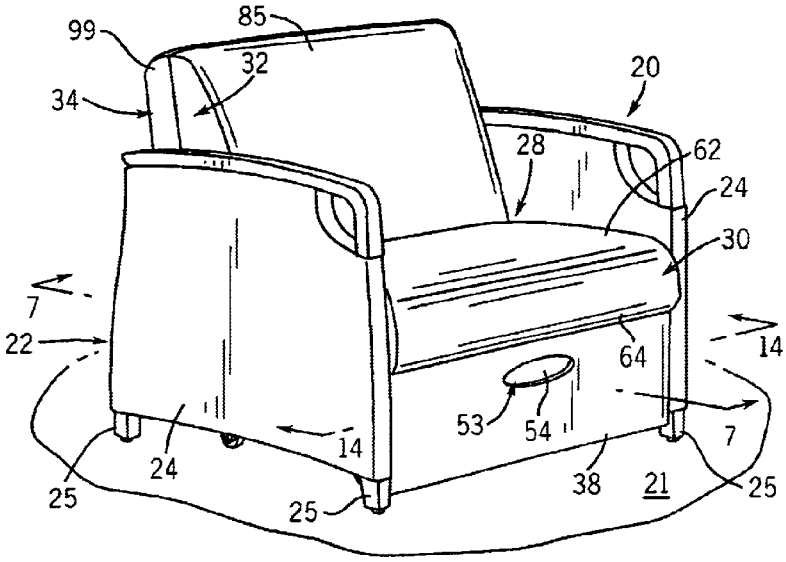
FIG. 1
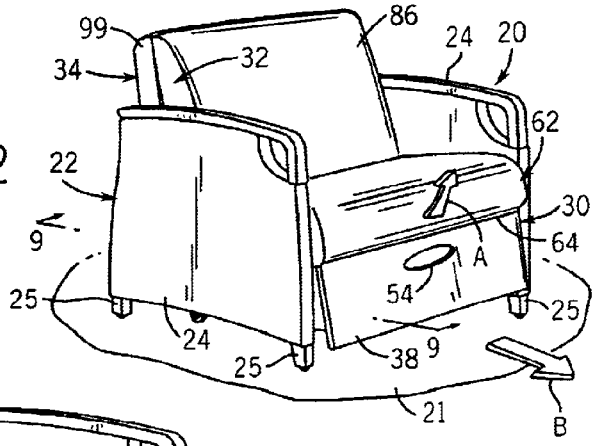
FIG. 2
FIG. 3
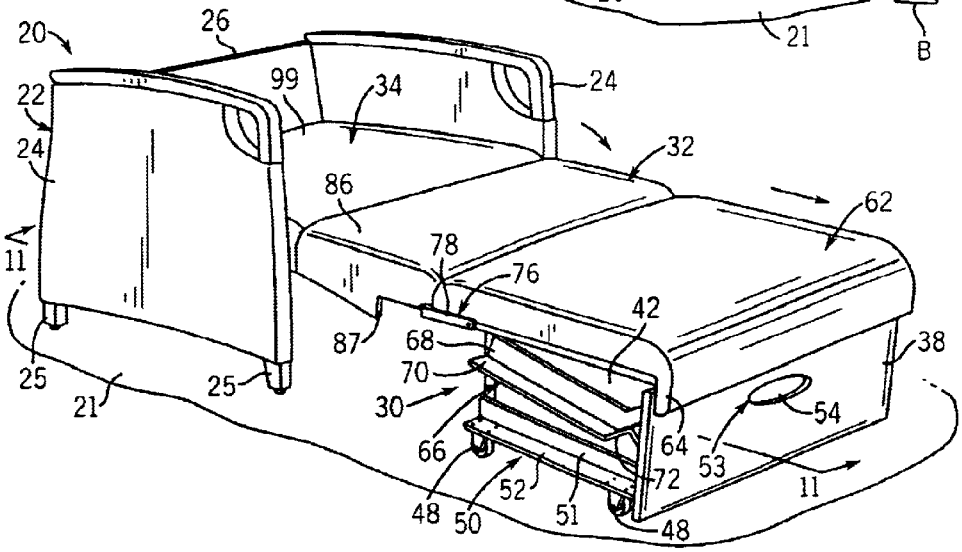

CONVERTIBLE SEATING FURNITURE

FIELD OF THE INVENTION

The present invention relates to chairs, and more specifically to chairs having an extendable support assembly incorporated within the chair to convert the chair from a seating configuration to a sleeping configuration.

BACKGROUND OF, THE INVENTION

Various types of chairs in which a portion of the chair can recline have been previously designed. These chairs allow an individual sitting in the chair to adjust the position of both the seat and backrest in order to provide a more accommodating seating position for the user of the chair. However, the majority of the designs of these reclining chairs require complex linkages and/or pivoting mechanisms within the chair in order to allow the reclining movement of the chair when desired. The complexity of the inner workings of these mechanisms requires that the assembly for the chairs incorporating them takes a significant period of time. These mechanisms also result in the chairs having a significant increase in overall weight. Further, while such reclining chairs are capable of adjusting the position of an individual sitting on the chair from an upright position to a reclined position, most prior art reclining chairs are not capable of reclining easily to provide a supine resting or sleeping surface for the individual.

Certain prior art chair designs have attempted to overcome these deficiencies for reclining chairs that can be moved from an upright position to a fully-reclined or supine position. One example of such a chair is disclosed in Suskey et al. U.S. Pat. No. 5,779,310. In this design, a telescoping extension assembly is formed of opposed pairs of rails connected to a stationary frame of the chair. In order to prevent the rails of the telescoping assembly from extending outwardly from the frame prematurely, or when not desired, the telescoping extension assembly includes a locking assembly formed of a spring-biased, retractable pin and bracket disposed on the rails. When the pin is retracted from within the bracket against the bias of the spring, the rails of the telescoping assembly can be pulled or extended outwardly from the frame. However, when the pin is positioned within the bracket, the assembly is prevented from telescoping so that the chair can be utilized in a conventional manner.

The particular construction of the telescoping chair assembly disclosed in the Suskey et al. '310 patent, while capable of providing a generally supine surface for an individual when desired, involves certain difficulties when moving the chair from the upright to the supine position. For example, the pin and bracket locking mechanism required for proper operation of the chair can malfunction such that the telescoping assembly cannot be released from or secured in the retracted position. Also, when the assembly is in the extended position, it is necessary to disengage a separate locking mechanism which holds the backrest in an upright position, to enable the backrest to be reclined into a supine position.

Therefore, it is desirable to develop a chair that is readily convertible from an upright position to a supine position, and that includes an extension mechanism for a support assembly that does not require a locking mechanism separate from the extension mechanism, and that synchronously moves the backrest into a supine position in coordination with the extension of the support assembly.

SUMMARY OF THE INVENTION

It is an object of the present invention to provide seating furniture in the form of a chair that is movable from an upright position to a supine position and that includes a self-locking, extendable support assembly.

It is another object of the present invention to provide such a chair in which the backrest for the chair automatically moves from an upright position to a supine position as the support assembly is extended from the chair.

It is a further object of the invention to provide such a chair in which the extendable support assembly provides a substantially seamless supine support surface when the chair is in the supine position.

It is still another object of the present invention to provide such a chair in which the extendable support assembly includes a minimum number of moving parts, to simplify construction and operation of the chair and to reduce the overall weight of the chair.

It is still a further object of the present invention to provide such a chair in which the extendable support assembly can be configured to include conventional seat cushions to provide sufficient comfort and support for an individual using the chair in either the upright or supine position.

The present invention is a reclining or convertible chair including an extendable support assembly which allows the chair to be moved from a conventional upright position to a fully-reclined, supine position. The chair includes a base to which the extendable support assembly is mounted. The chair can be moved between the upright and fully-reclined positions by simply moving the extendable support assembly with respect to the base, to place the support assembly in either an extended or a retracted position.

The base has a back panel and a pair of side members, which may be in the form of arm rests, that extend forwardly from opposite sides of the back panel. The extendable support assembly is positioned between the side members and is secured to a bracket connected between the side members. The support assembly includes a backrest pivotally secured to the bracket at one end, and to a movable pedestal at the opposite end. The backrest is constructed of a pair of sections that are pivotably interconnected together. The extendable support assembly is maintained in a retracted position between the side members by a pair of guide rails positioned on opposite sides of the pedestal. Each guide rail includes an angled portion and a notch disposed adjacent a front end of the pedestal. The notch on each guide rail is engageable with one of a pair of rollers positioned on opposite sides of the bracket, in order to maintain the pedestal in a retracted position.

To extend the pedestal and move the chair from an upright to a supine position, the front end of the pedestal is lifted to allow the roller to move out of the notch on each guide rail. The pedestal is then pulled forwardly such that the roller engages the angled portion of the guide rail, which is configured to guide the pedestal and allow the pedestal to move outwardly with respect to the base of the chair and into engagement with a supporting surface such as a floor. Simultaneously, the backrest sections pivot in a downward direction with respect to both the pedestal and the bracket such that the backrest is moved from the upright to the supine position in conjunction with outward movement of the pedestal.

To retract the assembly and move the chair from the supine position to the upright position, the pedestal is simply moved: towards the base of the chair, such that the backrest sections pivot together in an upward direction into the upright position. The pedestal is moved toward the base between the side members such that the rollers are reengaged within the notches on each guide rail.

Various other objects, features and advantages of the present invention will be made apparent from the following detailed description taken together with the drawing figures.

BRIEF DESCRIPTION OF THE DRAWINGS

The drawing figures illustrate the best mode currently contemplated of practicing the present invention.

In the drawings;

FIG. 1 is an isometric view of a convertible chair constructed according to the present invention, showing the chair in an upright position;

FIG. 2 is an isometric view of the convertible chair of FIG. 1 in a partially extended position;

FIG. 3 is an isometric view of the chair of FIG. 1 in a fully extended supine position;

DETAILED DESCRIPTION OF THE INVENTION

Figure 4:
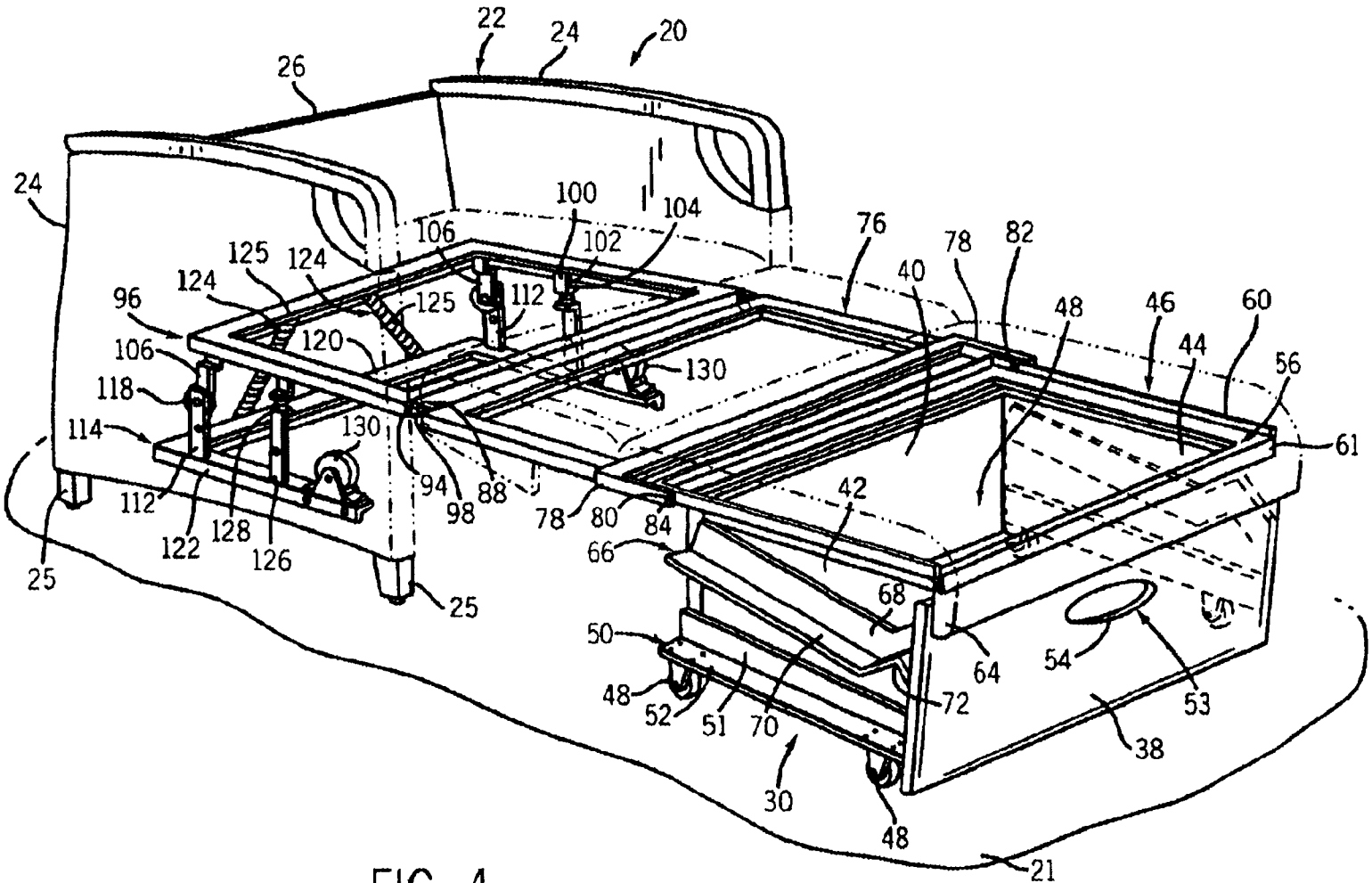
FIG. 4 is a partially broken-away view of the convertible chair of FIG. 3.
Figure 5:
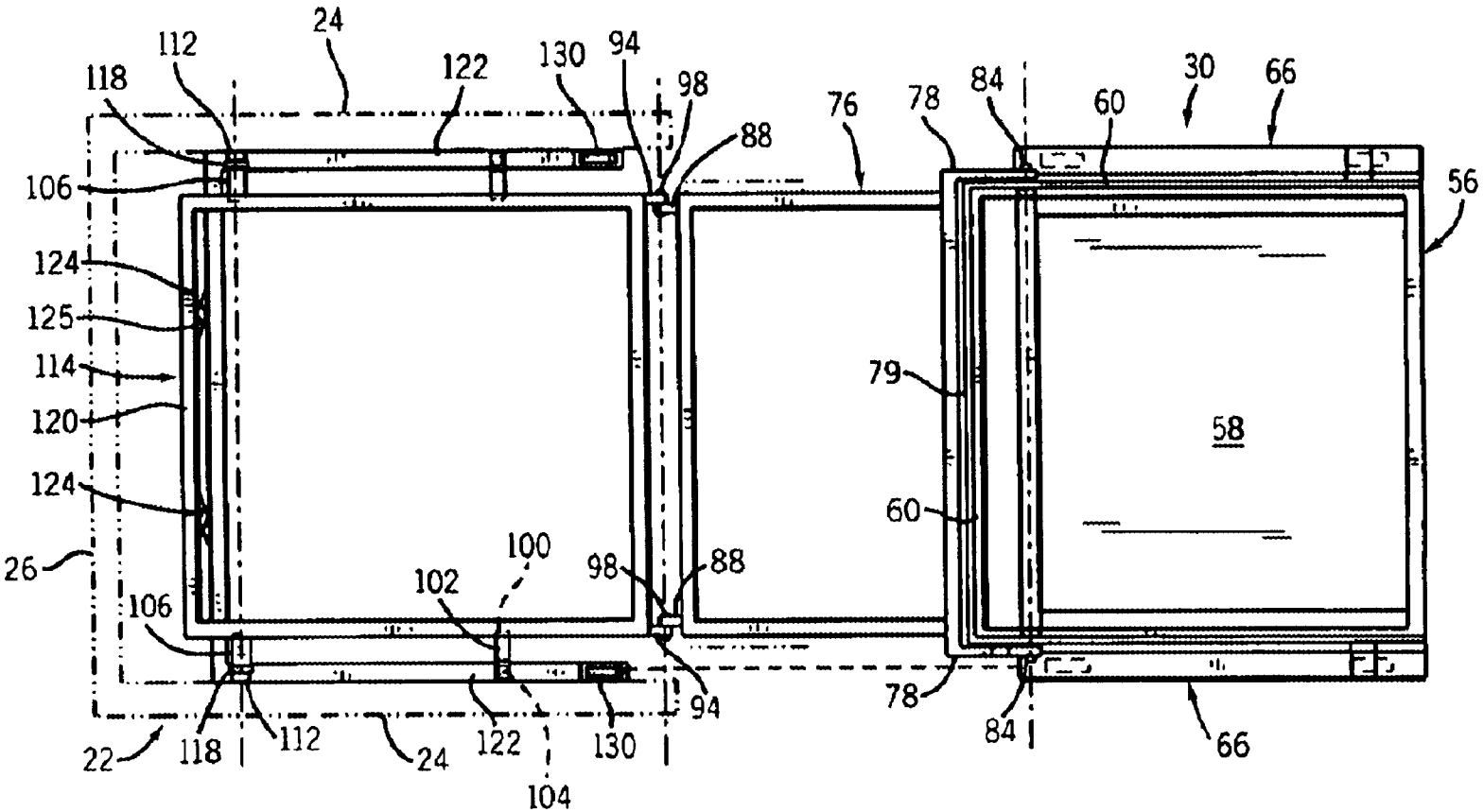
FIG. 5 is a top plan view of the convertible chair of FIG. 4.
Figure 6:
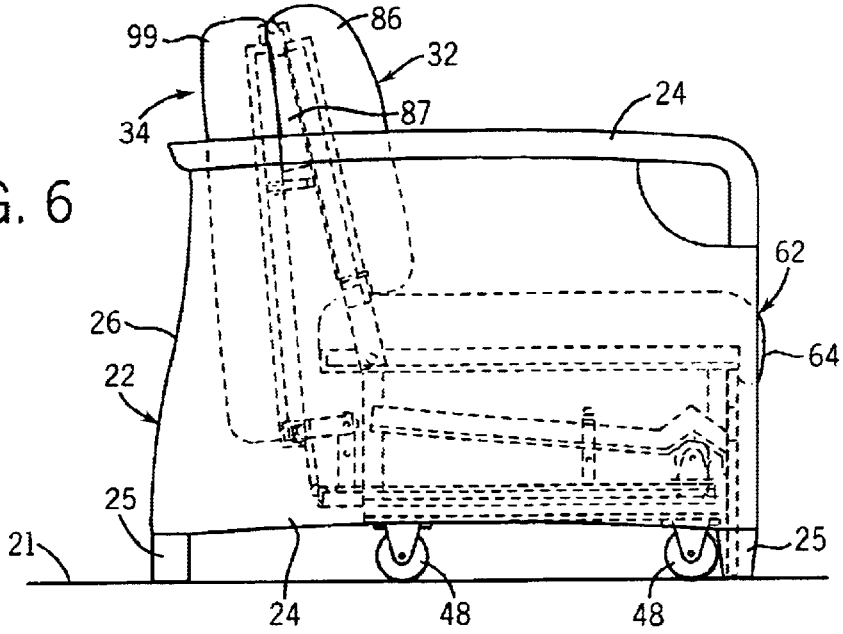
FIG. 6 is a side elevation view of the convertible chair of FIG. 1.
Figure 7:
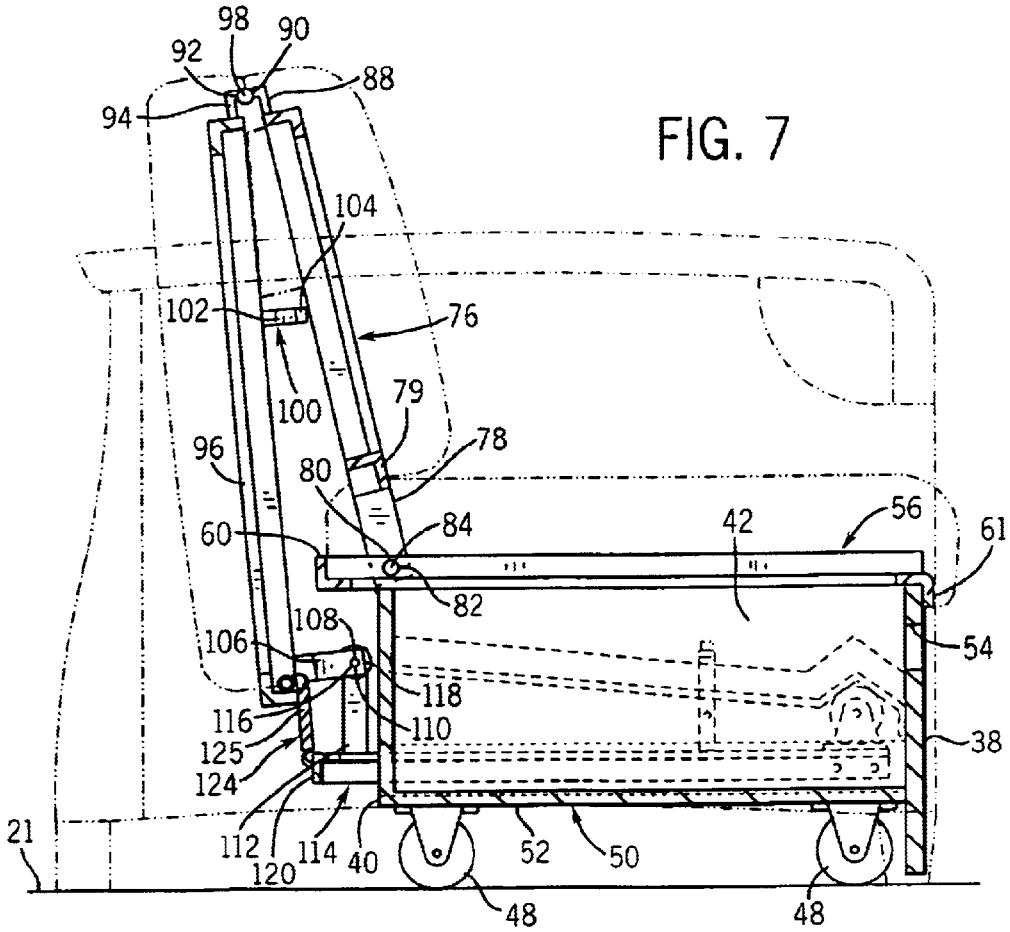
FIG. 7 is a cross-sectional view along line 7—7 of FIG. 1.
Figure 8:
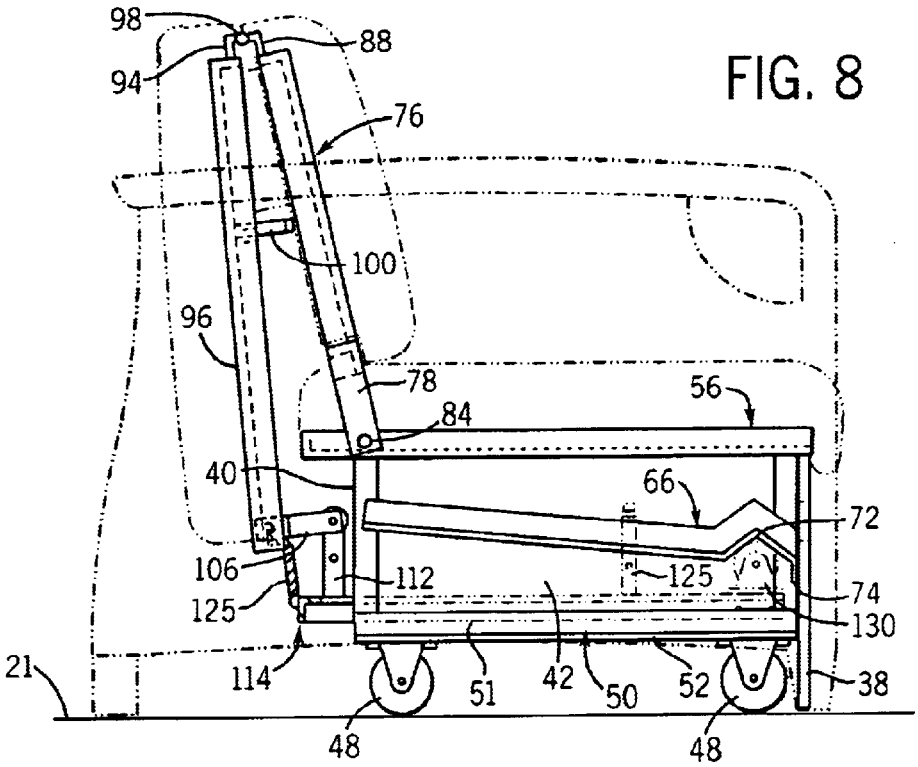
FIG. 8 is a view similar to FIG. 7, showing the support assembly of the chair in the upright position.
Figure 9:
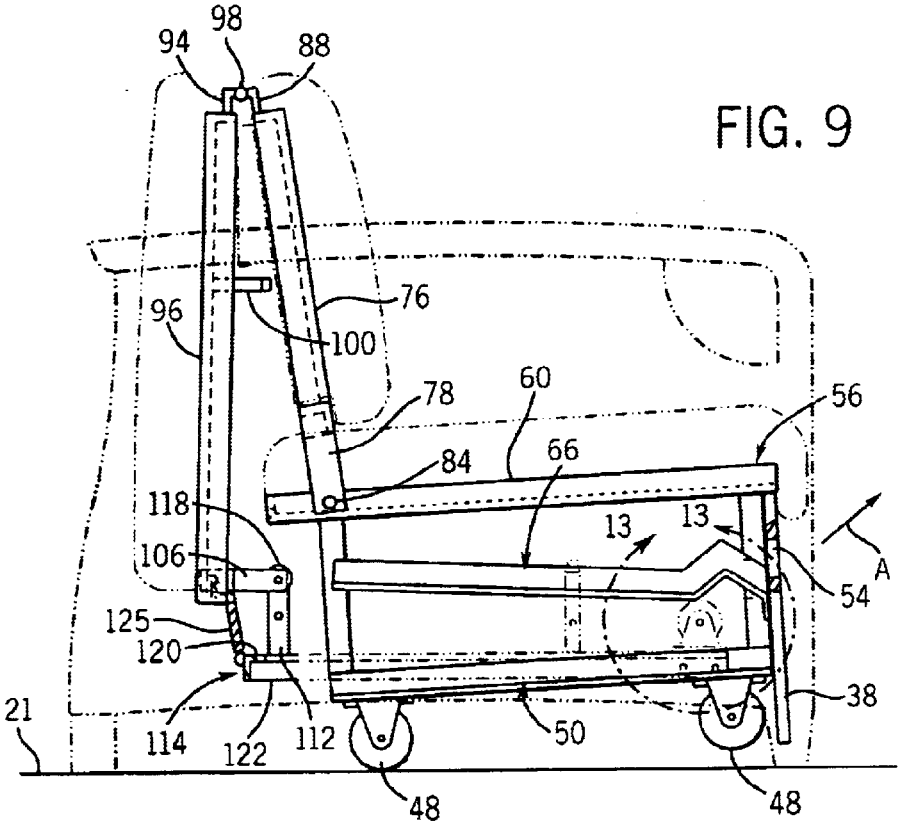
FIG. 9 is a view similar to FIG. 8, showing the support assembly in a disengaged position, with reference to line 9—9, of FIG. 2.
Figure 10:
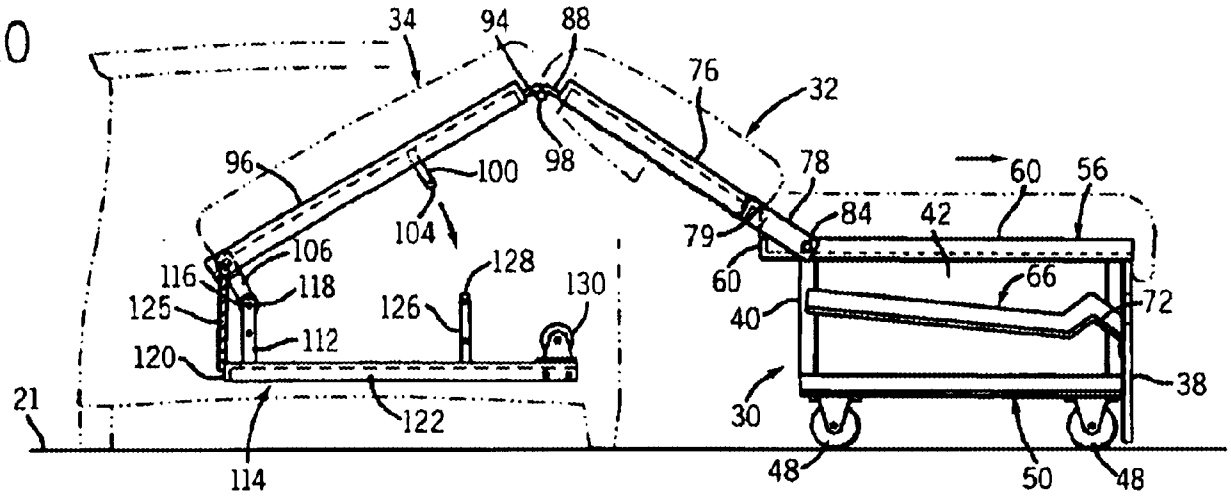
FIG. 10 is a view similar to FIGS. 8 and 9, showing the support assembly in a partially extended position.
Figure 11:
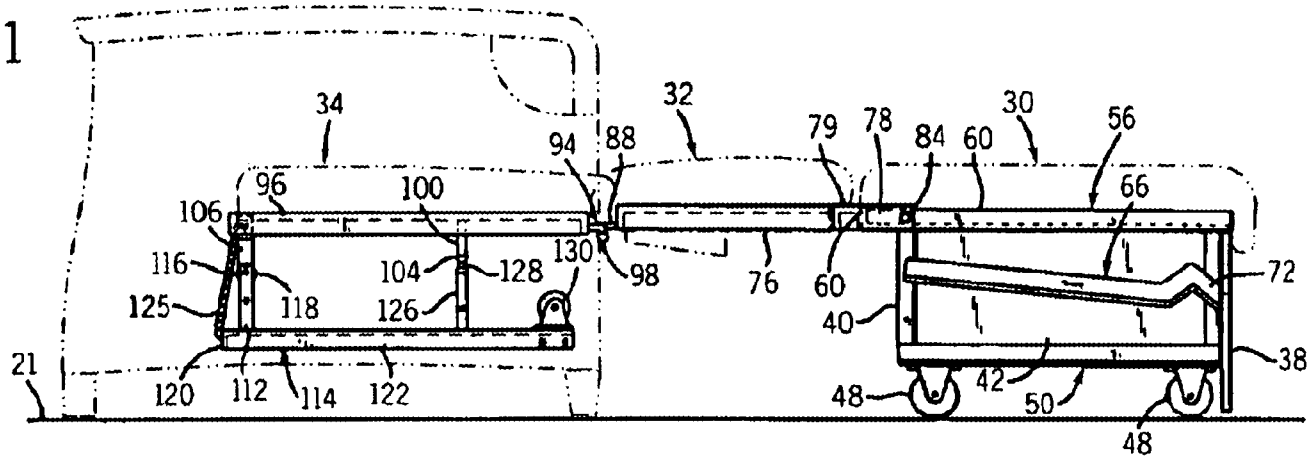
FIG. 11 is a view similar to FIGS. 8—10, showing the support assembly in the supine position, with reference to line 11—11 of FIG. 3.
Figure 12:
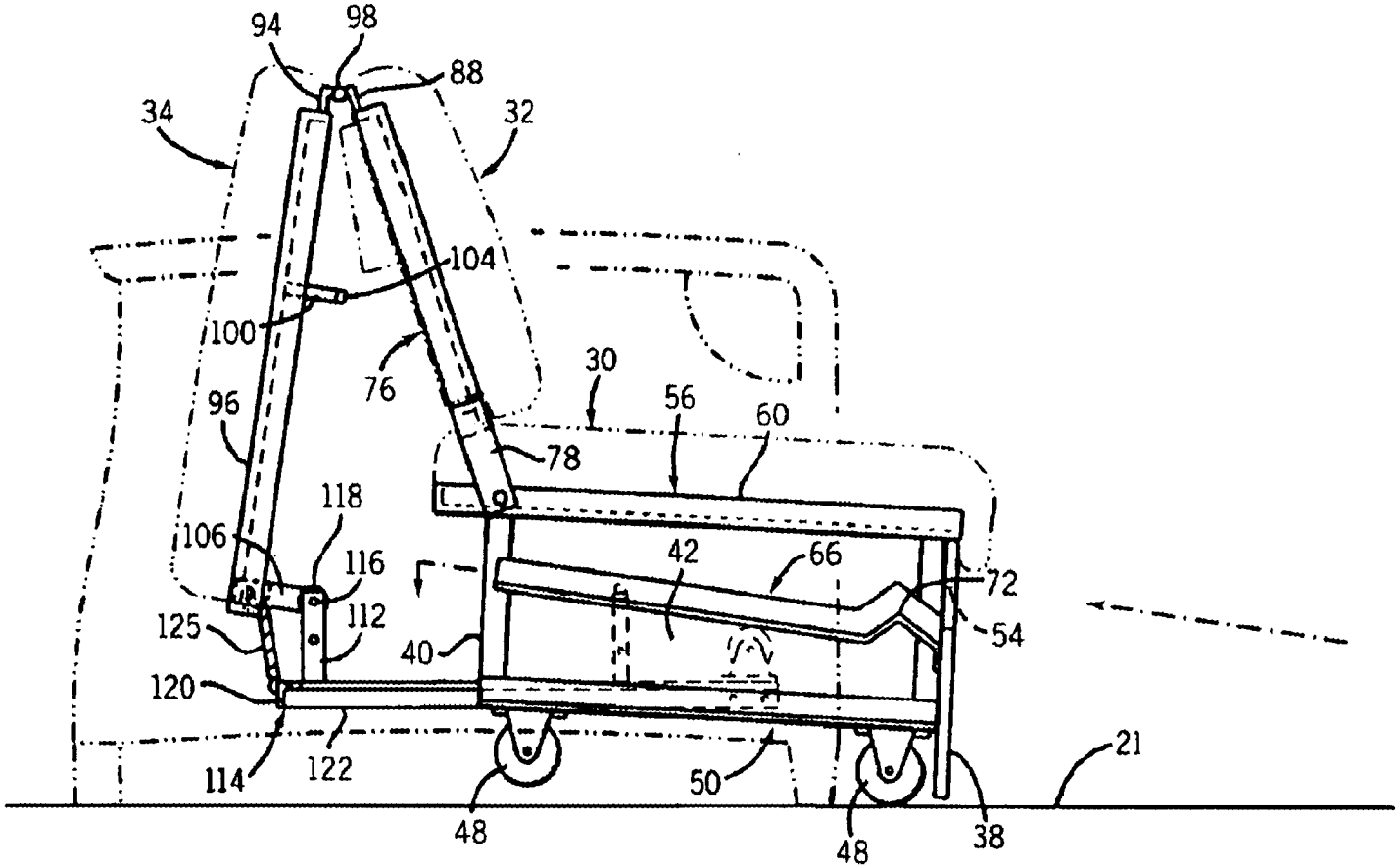
FIG. 12 is a view similar to FIGS. 8—11, showing the support assembly in a partially retracted position.

With reference to the drawing figures in which like reference numerals designate like parts throughout the disclosure, a convertible seating arrangement in the form of a convertible or reclining chair constructed according to the present invention is illustrated generally at 20 in FIG. 1. As best shown in FIGS. 1–3, the chair 20 is disposed on a support surface 21 such as a floor, and includes a base 22 having a pair of side members in the form of opposed arm rests 24 supported on legs 25 and attached to opposite sides of a back member in the form of a back panel 26. An extendable support assembly 28 is movably attached to the base 22 between the arm rests 24 and is movable with respect to the back panel 26.

Referring now to FIGS. 1–7, the extendable support assembly 28 includes a pedestal 30, a first backrest section or member 32, and a second backrest section or member 34. The pedestal 30 includes a rectangular box-shaped body 36 formed of a front panel 38, a rear panel 40, a pair of opposed side panels 42 and 44, and a top panel 46. Each of the front panel 38, rear panel 40, side panels 42 and 44 and top panel 46 are formed of a generally rigid material, such as a metal, wood or hard plastic; in order to provide adequate rigidity to the pedestal 30 when used by an individual for support as well as an aesthetically pleasing appearance. Further, the side panels 42 and 44 are attached to the front panel 38 and the top panel 46 inwardly from the opposed sides of the front panel 38 and top panel 46 to allow the front panel 38 and top panel 46 to cover other parts of the assembly 28 when the assembly 28 is positioned within the base 22.

The pedestal 30 is easily movable either towards or away from the base 22 by virtue of a series of casters 48, each of which is mounted to one of the side panels 42 and 44 by an L-shaped bracket 50 having a vertical portion 51 attached to the side panel 42,44 opposite the top panel 46. Further, a horizontal portion 52 of each bracket 50 effectively positions the casters 48 on either side of the pedestal 30 in a configuration that allows the pedestal 30 and casters 48 to be covered by the front panel 38 and top panel 46 when the assembly 28 is positioned entirely within the base 22.

The pedestal 30 can be moved towards or away from the base 22 on the casters 48 by grasping a handle 53 disposed on the front panel 38 to push or pull the pedestal 30 in the desired direction. The handle 53 can be formed in any conventional manner, such as by attaching a piece of rope, a wire, a metal rod, or other similar device to the exposed surface of the front panel 38. However, in a preferred embodiment the handle 53 is formed as an opening 54 in the front panel 38 to enable an individual to grasp the front panel 38 and move the pedestal 30.

A box or form 56 is positioned within the open interior of pedestal 30, and is normally closed by top panel 46. Form 56 has a generally open interior or center 58 and includes an upwardly extending ridge 60 extending over the rear panel 40 and side panels 42 and 44, and a downwardly extending ridge 61 positioned over and engageable with the front panel 38. Top panel 46 includes a cushion 62 formed of any suitable material utilized in the upholstering of chairs, and includes a downwardly extending lip 64 extending over the ridge 61 and the front panel 38 towards the handle 53 to provide added comfort for an individual utilizing the chair 20, particularly in the upright position. Top panel 46 may be removably mounted over the open top of form 56 to provide selective access to the open interior 58 of form 56. Alternatively, top panel 46 may be pivotably connected to pedestal 30 at its inner end, such that top panel 46 can be pivoted between a closed position as shown and an open position in which the outer end of top panel 46 is lifted upwardly to provide access to the open interior 58 of form 56. In this manner, pedestal 30 can be used for storage. This feature is especially useful when chair 20 is used in a hospital room or the like, to enable a visitor to store personal items when visiting a patient.

In order to limit and/or guide the movement of the pedestal 30 with respect to the base 22, the pedestal 30 also includes a pair of guide rails or tracks 66 secured one to each of the side panels 42 and 44. The guide tracks 66 arc each formed of a rigid material similar to the bracket 50, such as a metal or a hard plastic and are generally LRshaped with a vertical portion 68 secured to the side panel 42, 44, and a horizontal portion 70 extending outwardly perpendicular to the side panel 42, 44. The tracks 66 are covered by the front panel 38 and top panel 46 when the assembly 28 is positioned within the base 22 and are positioned on each side panel 42, 44 to extend upwardly at an angle in a direction from the front panel 38 toward the rear panel 40. Further, adjacent the front panel 38, each track 66 is 30 formed to include an upwardly-extending recess or notch 72. The end of the notch 72 adjacent the front panel 38 includes a downwardly extending tab 74 that is secured to the front panel 38, to assist in fixedly securing each track 66 to the pedestal body 36.

Opposite the front panel 38, the upper end of pedestal 30 is pivotally secured to the first backrest section 32. The first backrest section 32 includes a generally rectangular first frame member 76 having a pair of outwardly extending arms 78 at one end and an outwardly extending flange 79 disposed between the arms 78. Each of the arms 78 includes an opening 80 which is alignable with one of a pair of opposed openings 82 disposed in the upwardly extending ridge 60 of the pedestal 30. When the openings 80 and 82 are aligned with one another, a pin 84 is inserted through the aligned openings 80,82 such that the arms 78 and first frame member 76 are pivotally secured to the form 56 and pedestal 30.

The first backrest section 32 also includes a cushion 86 fixedly mounted to the first frame member 76 and formed of a material similar to the cushion 62 disposed on the top panel 46 of the pedestal 30. The cushion 86 includes a pair of opposed side sections 87 that are used to provide additional support to the first frame member 76 in the upright position. Also, the cushion 86 does not cover the arms 78 such that when the first frame member 76 is pivoted with respect to the pedestal 30, the cushion 86 moves along the contour of the cushion 62 to provide a seamless cushion surface in both the upright and supine positions.

Opposite the arms 78, the first frame member 76 further includes a second pair of outwardly extending arms 88 positioned inwardly from the sides of the second frame member 76, and each arm 88 includes an opening 90. The openings 90 are alignable with openings 92 disposed in a pair of arms 94 extending outwardly from a second frame member 96 of second backrest section 34. The pairs of arms 88 and 94 are connected by the insertion of a pair of pins 98 through the aligned openings 90 and 92 in order to form a pivoting connection between the first backrest section 32 and the second backrest section 34.

The second frame member 96 is generally rectangular in shape and is formed of a material similar to the material used to form the first frame member 76 and the form 56. The second frame member 96 supports a cushion 99 and includes a pair of stops 100 fixedly disposed on opposite sides of the first frame member 96 that extend perpendicularly to the first frame member 96. Each stop 100 includes an engaging surface 102 spaced from the first frame member 96, and a cushioning member 104 is mounted to each stop 100. Further, spaced from each stop 100 and located generally opposite the first frame member 76, the second frame member 96 includes a pair of pivot arms 106 mounted to and extending perpendicularly from the second frame member 96 parallel to the stops 100. Each of the pivot arms 106 includes an opening 108 spaced opposite the second frame member 96 that is alignable with one of a pair of openings 110 located in a pair of vertically extending pivot struts 112 supported by a bracket 114 connected to the base 22. The pivot arms 106 and pivot struts 112 are secured to one another by a pair of pins 116 inserted through the aligned openings 108 and 110. In a particularly preferred embodiment, the pins 116 support a friction-reducing bushing 118 between each pivot arm 106 and pivot strut 112 that is formed of a friction-reducing material to enable the pivot arms 106 to move smoothly with respect to the pivot struts 112.

The support bracket 114 is generally U-shaped and includes a central portion 120 and a pair of side portions 122 extending perpendicularly from opposite sides of the central portion 120. The support bracket 114 is formed of a rigid material similar to that used to form the first frame member 76, second frane member 96 and pedestal form 56, and has an overall width between the side portions 122 approximately equal to the space between the armrests 24. Each side portion 122 is fixedly secured to the adjacent armrest 24 such that the bracket 114 essentially forms a part of the base 22.

The support bracket 114 is also connected to the second frame member 96 by a pair of biasing members 124 connected between the central portion 120 and the second frame member 96. The biasing members 124 can be formed of any suitable resilient material, such as a stretchable rubber, but are preferably formed as springs 125 which act to bias the second frame member 96 to the upright position as best shown in FIGS. 7–12.

The support bracket 114 also includes a pair of braces 126 attached to each side portion 122 and spaced from the central portion 120. The braces 126 extend upwardly from each side portion 122, and each brace 126 includes a cushioning member 128 opposite the side portion 122. When the support assembly 28 is extended from the base 22, the stops 100 disposed on the second frame member 96 align with and contact the braces 126. Therefore, an individual resting on the assembly 28 in the supine position is provided additional support by the assembly 28 due to the, engagement of the stops 100 with the braces 126.

Further, in order to guide movement of the support assembly 28 between the retracted and extended positions, the support bracket 114 includes a pair of rollers 130 disposed on each side portion 122 opposite the rear portion 120. The rollers 130 engage the horizontal portion 70 of each guide track 66 in order to enable the pedestal 30 to be continually aligned with the base 22 during movement into or out of the base 22. Further, the rollers 130 are sized to enable the rollers 130 to be positioned within the notches 72 of each guide track 66 when the pedestal 30 is in its retracted position within the base 22, the to prevent the pedestal 30 from sliding outwardly with respect to the base 22, and to maintain the pedestal 30 in a horizontal or flat configuration with respect to the base 22.

Figure 13:
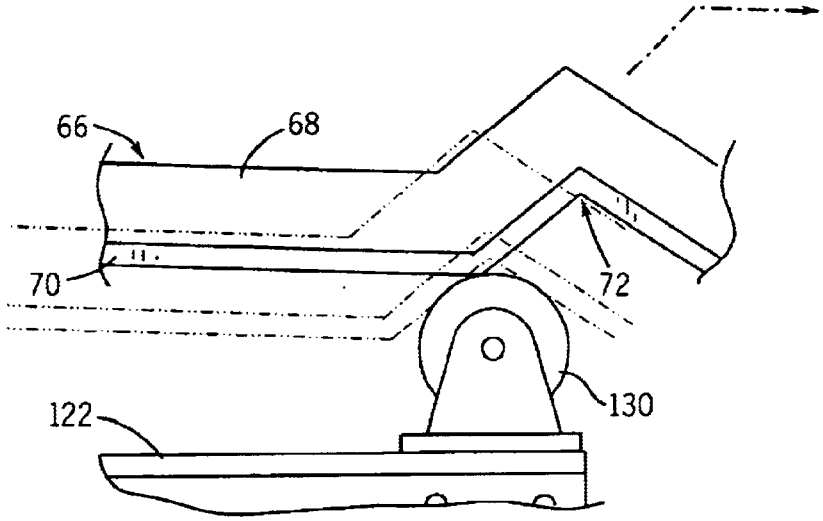
FIG. 13 is a partially broken away cross-sectional view along line 13—13 of FIG. 9.
Figure 14:
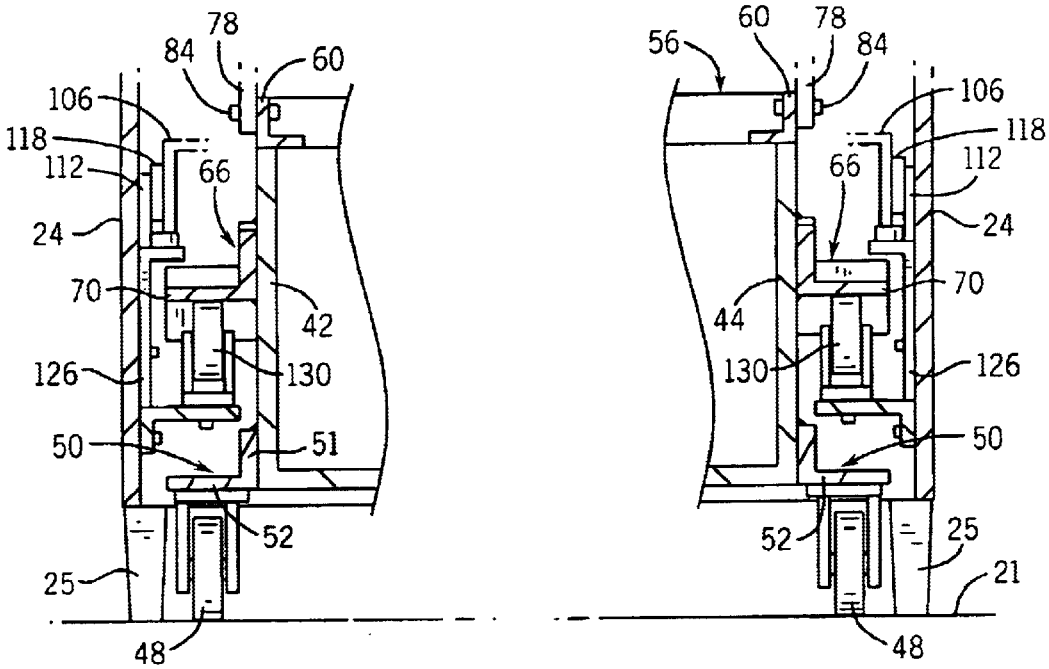
FIG. 14 is a cross-sectional view along line 14—14 of FIG. 1.

In operation, chair 20 functions as follows for movement between its retracted upright position and its extended supine position. As shown in FIGS. 1–3 and 8–14, in order to move the support assembly 28 from the upright position to the supine position, initially an individual grasps the handle 53 on the front panel 38 of the pedestal 30 and pulls upwardly on the front panel 38 to lift the front end of the pedestal 30 with respect to the base 22 in the direction shown by arrow A in FIGS. 2 and 9. By doing so, the rollers 130 are displaced from within the notches 72 of each guide track 66, enabling the pedestal 30 to move with respect to the base 22. As best shown in FIGS. 2 and 13,1 the individual then pulls forwardly on the pedestal 30 in the direction shown by arrow B such that the rollers 130 contact the horizontal portion 70 of each track 66 outside of the notch 72, and allow the pedestal 30 to be pulled forwardly out of the base 22. As the rollers 130 move along the horizontal portion 70 of each track 66, the pedestal 30 is lowered until all of the casters 48 are positioned on the support surface 21 on which the chair 20 is disposed.

Simultaneously with the pedestal 30 being moved out of the base 22, the first frame member 76 and second frame member 96 are pivoted with respect to the pedestal 30, base 22, and one another. More specifically, referring now to FIGS. 3, 4, 10 and 11, as the pedestal 30 is moved forwardly out of the base 22, the first frame member 76 pivots downwardly with respect to the pedestal 30 to an extended position where the first frame member 76 is positioned parallel to the form 56. Simultaneously, the second frame member 96 is pivoted downwardly with respect to the base 22 and first frame member 76 until the stops 100 contact the braces 126. In this position, the form 56, the first frame member 76, and second frame member 96 are positioned parallel to and in the same plane as one another, such that the cushions 62, 86 and 99, respectively, form a generally planar, supine support surface. Additional support for an individual using the chair 20 in the supine position is provided by the engagement of the first frame member 76 with the upwardly extending ridge 60 of the form 56, and the engagement of the stops 100 with the braces 126, such that the assembly 28 will not bow in the middle when placed in the supine position. Also, as the second frame member 96 pivots downwardly, the biasing members 124 are extended, causing tension to be applied between the support bracket 114 and the first frame member 96.

From the supine position, in order to move the support assembly 28 back to the upright, retracted position as shown in FIG. 12, an individual again grasps the handle 53 on the pedestal 30 to push the pedestal 30 towards the base 22. By doing so, the second flame member 96 pivots upwardly with respect to the base 22, as assisted by the springs 124, which consequently urge the second frame member 76 to pivot upwardly with respect to the pedestal 30 and second frame member 96. The, user continues to push pedestal 30 toward and into the open front of the base 22 until the rollers 130 contact the guide tracks 66 and are repositioned within the notches 72 of each guide track 66 and the stops 100 on the first frame member 96 engage the second frame member 76. Simultaneously, the stops 100 are moved away from the braces 126. Each stop 100 contacts the second frame member 76 to provide additional support to the assembly 28 in the upright position along with the side sections 87 of the cushion 86 which contact the second frame member 96. During such inward movement of pedestal 30, engagement of rollers 130 with guide tracks 66 is operable to raise pedestal 30 upwardly such that casters 48 are moved out of engagement with support surface 21. In this manner, casters 48 are concealed by the lower areas of arm rests 24 when chair 20 is placed in its retracted upright position.

When chair 20 is placed in its extended supine position, the user is able to access the open interior 58 of form 56 by moving pedestal top panel 46 from its closed position to its open position as described above, to provide storage of the users personal items or the like.

It can thus be appreciated that chair 20 provides a relatively simple and easily operated arrangement for converting chair 20 from an upright sitting configuration to a supine sleeping configuration. This convertibility of chair 20 is especially useful in a hotel or hospital application, to provide both a seating function and a sleeping function.

Various alternatives are contemplated as being within the scope of the following claims particularly pointing out and distinctly claiming the subject matter regarded as the invention.

I hereby claim:

1. A convertible furniture arrangement for placement on a support surface, comprising:

a base including a pair of side members and a rear member interconnected with and extending between the side members,:wherein an open area is defined by the side members and the rear member;

a pedestal defining an upwardly facing support surface and configured to be received within the open area;

a back arrangement interconnected between the base and the pedestal, including a first back section pivotably interconnected with the base and a second back section pivotably interconnected with the pedestal, wherein the first and second back sections are pivotably interconnected together;

wherein the pedestal is movable relative to the base between a retracted position in which the pedestal is received within the open area and an extended position in which the pedestal is moved outwardly relative to the base, and wherein the first and second back sections cooperate to define an upright back arrangement when the pedestal is in the retracted position and an upwardly facing support surface when the pedestal is in the extended position; and an elevating engagement arrangement interposed between the pedestal and the base, wherein the elevating arrangement is configured and arranged to raise the pedestal upwardly out of engagement with the support surface when the pedestal is moved between the extended position and the retracted position, and to lower the pedestal into engagement with the support surface when the pedestal is moved away from the retracted position toward the extended position.

2. A convertible furniture arrangement for placement on a support surface, comprising:

a base including a pair of side members and a rear member interconnected with and extending between the side members, wherein an open area is defined by the side members and the rear member;

a pedestal defining an upwardly facing support surface and configured to be received within the open area;

a back arrangement interconnected between the base and the pedestal, including a first back section pivotably interconnected with the base and a second back section pivotably interconnected with the pedestal, wherein the first and second back sections are pivotably interconnected together;

wherein the base includes a bracket to which the first back member is pivotably connected and wherein the pedestal is movable relative to the base between a retracted position in which the pedestal is received within the open area and an extended position in which the pedestal is moved outwardly relative to the base, and wherein the first and second back sections cooperate to define an upright back arrangement when the pedestal is in the retracted position and an upwardly facing support surface when the pedestal is in the extended position; and an elevating engagement arrangement interposed between the pedestal and the base for raising the pedestal upwardly out of engagement with the support surface when the pedestal is in the retracted position, and for lowering the pedestal into engagement with the support surface when the pedestal is moved away from the retracted position toward the extended position, and wherein the elevating engagement arrangement includes at least one roller interconnected with the bracket, and a guide track secured to the pedestal, wherein the guide track is arranged to engage the roller when the pedestal is moved to the retracted position and is configured to raise the pedestal when the pedestal is moved from the extended position to the retracted position and to lower the pedestal when the pedestal is moved from the retracted position to the extended position.

3. The convertible furniture arrangement of claim 2, wherein the guide track includes a recessed area within which the roller is engaged when the pedestal is in the retracted position, to releasably retain the pedestal in the retracted position.

4. The convertible furniture arrangement of claim 3, wherein the guide track includes a plate section positioned against the side of the pedestal and a flange extending outwardly generally perpendicular to the side of the pedestal.

5. The convertible furniture arrangement of claim 3, wherein the bracket includes a pair of guide rollers disposed one on each of a pair of opposite sides defined by the bracket and wherein the pedestal includes a pair of guide tracks disposed on opposite sides of the pedestal, each guide track including a recessed area within which one of the guide rollers is received.

6. The convertible furniture arrangement of claim 1, wherein the pedestal includes a plurality of casters for movably supporting the pedestal on the supporting surface.

7. The convertible furniture arrangement of claim 1, wherein the first and second back sections are generally coplanar with the upwardly facing support surface of the pedestal when the pedestal is in the extended position.

8. An extendible support assembly connectable to an article of seating furniture having a pair of sides and a rear member extending between the sides, the support assembly comprising:

a bracket adapted to be secured between the pair of sides, each bracket including a guide roller;

a backrest assembly pivotally secured to the bracket; and a pedestal pivotally connected to the backrest assembly opposite the bracket, wherein the pedestal is movable between a retracted position and an extended position, wherein the pedestal defines a pair of sides and includes a guide track positioned on each side which is oriented so as to be engageable with one of the guide rollers, wherein each guide track is oriented on the pedestal to extend upwardly at an angle from a front end of the pedestal toward a rear end of the pedestal, and wherein each guide track includes an upwardly extending notch adjacent the front end of the pedestal in which one of the guide rollers is received when the pedestal is in the retracted position, wherein the guide tracks and the guide rollers are oriented to elevate the pedestal when the pedestal is moved from the extended position to the retracted position.

9. The support assembly of claim 8, wherein the bracket is generally U-shaped, and includes a central portion extending between and connected to one end of a pair of side portions adapted to be secured to the side members.

10. The support assembly of claim 9, further comprising a biasing member connected between the backrest assembly and the bracket, wherein the biasing member is configured to bias the pedestal toward the retracted position and to bias the backrest assembly toward an upright position.

11. The support assembly of claim 8, wherein the backrest assembly comprises a first frame member pivotally connected to the pedestal, and a second frame member pivotally connected to the first frame member and to the bracket opposite the first frame member.

12. The support assembly of claim 11, wherein the second frame member includes a stop extending generally perpendicularly from the second frame member, wherein the stop is engageable with a brace positioned on the bracket when the pedestal is in the extended position, and is engageable with the first frame member when the pedestal is in the retracted position.

13. The support assembly of claim 12, further comprising a compressible member disposed on one of the stop or the brace and engageable with the other of the stop or the brace.

14. The support assembly of claim 12, further comprising a compressible member disposed on one of the stop or the first frame member and engageable with the other of the stop or the first frame member.

15. The support assembly of claim 11, wherein the second frame member includes a pivot arm extending generally perpendicularly from the second frame member and movably connected to a pivot strut disposed on the bracket.

16. The support assembly of claim 8, further comprising a plurality of wheels disposed on the pedestal and engageable with a support surface for facilitating movement of the pedestal between the extended and retracted positions.

17. The support assembly of claim 8, wherein the pedestal includes a front panel having a handle that can be used to move the pedestal between the , retracted position and the extended position.

18. A method for moving an article of seating furniture between an upright position and a supine position, wherein the article of furniture includes a pair of armrests the method comprising the steps of:

providing a base and an extendable support assembly connected to the base and movably positioned between the armrests, the support assembly including a bracket connected to the base, a guide roller fixed to the bracket, a backrest assembly pivotally connected to the bracket, and a pedestal pivotally connected to the backrest assembly opposite the bracket, wherein the pedestal includes a guide track positioned on a side of the pedestal and engageable with the guide roller, the guide track including a retainer structure with which the guide roller is engaged when the seating furniture is in the upright position;

disengaging the guide roller from the retainer structure; and moving the pedestal away from the base to place the seating furniture in the supine position.

19. The method of claim 18, wherein the retainer structure comprises a notch associated with the guide track and configured to receive the guide roller when the seating arrangement is in the upright position.

20. The method of claim 19, wherein the step of disengaging the guide roller from the notch comprises the steps of:

lifting the pedestal and the notch upwardly with respect to the roller;

pulling the pedestal forward with respect to the base to misalign the roller and the notch; and lowering the pedestal onto the guide track.

21. The method of claim 20, wherein the step of lifting the pedestal comprises the steps of grasping a handle disposed on the front end of the pedestal, and lifting the handle with respect to the base.

22. The method of claim 19, further comprising the step of lowering the backrest assembly from a generally vertical position to a generally horizontal position simultaneously with moving the pedestal away from the base.

23. The convertible furniture arrangement of claim 1, wherein the elevating arrangement is further configured and arranged to releasably maintain the pedestal in the retracted position.

* * * * *